US010643828B2

(12) United States Patent
Solouki

(10) Patent No.: US 10,643,828 B2
(45) Date of Patent: May 5, 2020

(54) HIGH RESOLUTION IMAGING MASS SPECTROMETRY

(71) Applicant: BAYLOR UNIVERSITY, Waco, TX (US)

(72) Inventor: Touradj Solouki, Hewitt, TX (US)

(73) Assignee: Baylor University, Waco, TX (US)

( * ) Notice: Subject to any disclaimer, the term of this patent is extended or adjusted under 35 U.S.C. 154(b) by 294 days.

(21) Appl. No.: 15/268,097

(22) Filed: Sep. 16, 2016

(65) Prior Publication Data

US 2017/0084435 A1 Mar. 23, 2017

Related U.S. Application Data

(60) Provisional application No. 62/220,452, filed on Sep. 18, 2015.

(51) Int. Cl.

*H01J 49/00* (2006.01)
*H01J 49/10* (2006.01)
*H01J 49/04* (2006.01)

(52) U.S. Cl.

CPC ..... *H01J 49/0004* (2013.01); *H01J 49/0463* (2013.01); *H01J 49/105* (2013.01)

(58) Field of Classification Search

CPC ..... H01J 49/00; H01J 49/02; H01J 49/0004; H01J 49/0418; H01J 49/0463; H01J 49/10126; H01J 49/14; H01J 49/161; H01J 49/164; H01J 49/36

USPC ..... 250/281, 282, 288

See application file for complete search history.

(56) References Cited

U.S. PATENT DOCUMENTS 4,472,631 A * 9/1984 Enke ..... B01D 59/44 250/281
4,920,264 A * 4/1990 Becker ..... G01N 1/42 250/282
9,818,593 B2 11/2017 Solouki
2002/0037517 A1* 3/2002 Hutchens ..... G01N 33/68 435/6.12

(Continued)

OTHER PUBLICATIONS

Fenn, J.B., Mann, M., Meng, C. K. and Wong S.F.. *Electrospray Ionization for Mass Spectrometry of Large Biomolecules*. 9 Mass Spectrometry Rev. 37-70 (1990).

(Continued)

*Primary Examiner* — Jason L McCormack
(74) *Attorney, Agent, or Firm* — Jackson Walker, LLP

(57) ABSTRACT

The present disclosure provides a system and method for mass spectrometry imaging in a multi-stage ionization applying different technologies by decoupling the desorption and ionization events. At a first stage, a primary beam, such as an ion beam, desorbs one or more molecules of a targeted sample, and at a second stage the desorbed molecules are ionized. The system and method can act independent of a matrix application to the target sample for a direct analysis and has the spatial resolution needed to operate in nano-meters resolution for a cell-by-cell analysis, if desired. The first stage desorption applies a first technique that allows neutral molecules of the target sample to become desorbed from the surface without requiring the molecules to be ionized during the desorption. The second stage ionizes the neutral molecules after the desorption in the first stage, when the defined target molecules have been volatilized.

11 Claims, 1 Drawing Sheet

(56) References Cited

U.S. PATENT DOCUMENTS

| | | | | |
|---|---|---|---|---|
| 2005/0017167 | A1* | 1/2005 | Franzen | H01J 49/0054 250/288 |
| 2005/0199797 | A1* | 9/2005 | Schubert | B01D 59/46 250/283 |
| 2015/0235829 | A1* | 8/2015 | Chung | H01J 49/0031 250/282 |

OTHER PUBLICATIONS

Karas, M., Bachmann, D., Bahr, U. and Hillenkamp, F. *Matrix-Assisted Ultraviolet Laser Desorption of Non-Volatile Compounds, 78*. Int'l. J. Mass Spectrometry & Ion Processes 53-68 (1987).

Zekavat, B. and Solouki, T. *Radio-Frequency Ionization of Organic Compounds for Mass Spectrometry Analysis 52*. Angew. Chem. Int. Ed. 2426-2429 (2013).

Rohner, T., Staab, D., and Stoeckli, M. *MALDI Mass Spectrometric Imaging of Biological Tissue Sections*, 126 Mechanisms of Ageing and Development 177-185 (2005).

Sundqvist, B. and Macfarlane, R. D. *252Cf-Plasma Desorption Mass Spectrometry, 4*. Mass Spectrometry Rev. 421-460 (1985).

Penner-Hahn, J.E. Technologies for Detecting Metals in Single Cells, 12. Metallomics and the Cell, Metal Ions in Life Sciences 15-40 (L. Banci Ed. 2013).

* cited by examiner

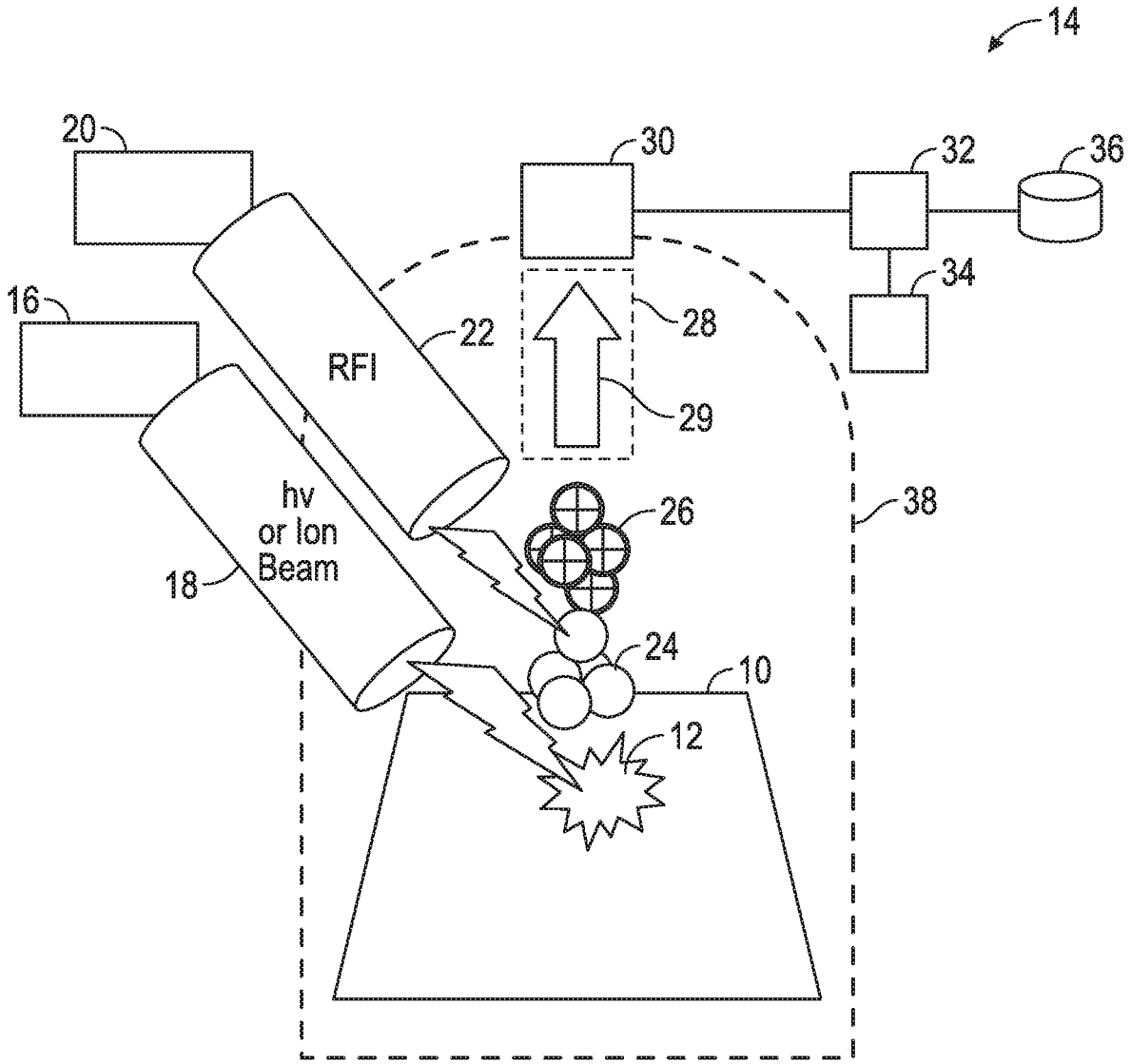
14
20
30
32
36
16
34
22
28
RFI
29
hv
or Ion
Beam
26
38
18
24
10
12

HIGH RESOLUTION IMAGING MASS SPECTROMETRY

CROSS REFERENCE TO RELATED APPLICATIONS

This application claims the benefit of U.S. Provisional Application No. 62/220,452, filed Sep. 18, 2015, which is incorporated by reference herein.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to mass spectrometry. More specifically, the disclosure relates to high resolution imaging mass spectrometry.

Description of the Related Art

Mass spectrometry ("MS") is increasingly being used to analyze the composition of materials. Literature generally describes MS as an analytical technique that produces spectra of the masses of the atoms or molecules of a sample of material. The spectra are used to determine the elemental compositions or isotopic signatures of a sample, the masses of particles and of molecules, and if applicable, the chemical structures of molecules, such as peptides and other chemical compounds. MS works by ionizing compounds to generate charged molecules or molecule fragment ions and measuring their mass-to-charge ("m/z") ratios, which can be correlated to a particular atom, molecule, or compound. In a typical MS procedure, a sample is first ionized. The sample may be solid, liquid, or gas. The ionization may for example, occur by bombarding the sample with electrons to cause some of the sample's molecules to break into charged molecules or fragments as ions. These ions are then separated according to their m/z ratio, typically by accelerating them and subjecting them to an electric or magnetic field, or combination of both fields. Motions of ions of the same m/z ratio as a species will be influenced similarly by the electric field (E), magnetic field (B), or E×B crossed fields, and undergo the same amount of deflection from their original trajectories. After ion separation, the ions are detected by a detector, which records the m/z for each species and results are displayed as spectra of the relative abundance of detected ions as a function of the m/z ratio. The atoms or molecules in the sample can be identified by correlating known masses to the identified masses or through a characteristic fragmentation pattern.

In MS, ionization refers to the production of gas phase ions suitable for resolution in the mass analyzer or mass filter. Although there are several ion sources that are available, ionization techniques have been described as belonging to either hard or soft ionization techniques. Hard ionization techniques include processes that impart high quantities of residual energy in the subject molecule and invoke large degrees of ion fragmentation. For singly-charged ions, resulting ions tend to have m/z ratios lower than the molecular mass. The most common example of hard ionization is Electron Impact (EI) ionization and other examples are Cf desorption and laser desorption.

Soft ionization refers to the processes which impart very little residual energy onto the subject molecule and thus result in very little ion fragmentation. Often, it is advantageous to avoid ion fragmentation to simplify the MS complexity and increase a signal-to-noise ratio for identification of an unknown substance through the identification of intact molecular ions. Examples include matrix-assisted laser desorption ionization ("MALDI"), electrospray ionization ("ESI"), chemical ionization ("CI"), and field desorption.

The literature also states that mass spectrometry imaging (also known as imaging mass spectrometry or "IMS") is a technique used in mass spectrometry to visualize the spatial distribution of substances, such as compounds, biomarker, metabolites, peptides or proteins by their molecular masses. Emerging technologies in the field of IMS include MALDI imaging and secondary ion mass spectrometry ("SIMS") imaging.

MALDI imaging techniques use a process in which a sample, typically a thin tissue section, is moved in front of a laser beam in two dimensions while the mass spectra are recorded. Generally. MALDI uses a matrix substance applied to a sample tissue. In MALDI, a laser ionizes the matrix substance applied to the sample tissue. A known issue with MALDI is that the application of the matrix substance to the sample tissue can cause migration of small cells and/or sample components that affect the accuracy of an analysis on a cell-by-cell resolution. Moreover, MALDI matrix may interact with surface chemicals and lead to bias analysis of certain classes of compounds. Further, a MALDI technique is generally only capable of probing in the 5-50 micro-meter (μm) range due to the large dimensions of the laser spot caused by a light diffraction limit.

However, single cell IMS for atoms or molecules within the cell components require substantially higher spatial resolving power. A cellular level analysis needs an order or two magnitude greater spatial resolution, such as in the nanometer range, than traditional MALDI provides. This high of a spatial resolution is beyond traditional MALDI's capabilities, although improvements are being made in MALDI's resolution to reduce laser ablation spot sizes to below 5 micron.

SIMS is used to analyze solid surfaces and thin films by sputtering the surface with a focused beam of ions (as primary ions) sometimes at high resolution of about 50 nano-meters, which causes ions of the sample to desorb. An analyzer collects and analyzes the ejected secondary ions of the sample. SIMS imaging is performed in a manner similar to electron microscopy; the primary ion beam is rastered across the sample while secondary mass spectra are recorded, SIMS is considered a hard ionization technique due to its significant energy imparted into the surface that causes fragmentation of ions. For some applications, the fragmentation is useful or at least acceptable, such as when analyzing metal atoms in a sample, where the molecules of the sample can be fragmented leaving the desired atom of the metal for further analysis. However, for sensitive or labile samples, such as proteins and other biological samples. SIMS can be too destructive to the sample to analyze various aspects of the sample.

Mile advances have been made in IMS, there are currently no known methods for desorbing intact molecules from smaller than one micron surfaces using soft ionization approaches. Although MALDI can desorb and concurrently ionize with a laser and an applied matrix for soft desorption, the resolution of a MALDI process is too large for cell-by-cell or particularly subcellular structures or other small samples that may be dislodged or otherwise desorbed for analysis by a mass spectrometer. SIMS has the capability of such small resolution, but with its hard ionization, can result in fragmentation that disrupts the structure of the molecule that is being sought to analyze.

Recent efforts have shown that radiofrequency can be used to ionize molecules. However, radio frequency ionization ("RFI") may not have the resolution to directly desorb smaller selected portions of a sample.

There remains then a need to provide an improved system and method for mass spectrometry that allows soft desorption of a sample and subsequent ionization, but with sufficiently high image resolution to analyze sub-cellular sized structures.

BRIEF SUMMARY OF THE INVENTION

The present disclosure provides a system and method for mass spectrometry imaging in a multi-stage ionization applying different technologies by decoupling the desorption and ionization events. At a first stage, a primary beam, such as an ion beam, desorbs one or more molecules of a targeted sample, and at a second stage the desorbed molecules are ionized. The system and method can act independent of a matrix application to the target sample for a direct analysis and has the resolution needed to operate in nanometers resolution for a cell-by-cell analysis, if desired. In the first stage and for the desorption of neutrals, first, a desorption technique, such as an ion beam, is applied to allow neutral molecules of the target sample to become desorbed from the surface without requiring the molecules to be ionized during the desorption. Subsequently, in the second stage and after the desorption and volatilization of defined targeted neutrals from the surface in the first stage, an ionization technique is applied so that the MS analysis can be focused on the ionized target molecules. The second stage can use, for example, radiofrequency ionization, different from the first stage. The system and method of the present invention may provide advantages over MALDI and SIMS of: softer desorption enabled by a larger ionization cross-section of the second stage to yield molecular and fragment ions for analysis of peptides and proteins; small spot size for increased resolution without sacrificing sensitivity, tuneable ionization to meet the needs of various molecular fragmentation patterns; increased spatial resolving power by reduced pixel and voxel sizes, direct analysis without the use of a matrix applied to the sample that can contaminate the sample and cause intra-sample molecular migration to skew results, and increased compatibility with mass analyzers and detectors.

The disclosure provides a system for a mass spectrometry, comprising: a desorption beam configured to desorb neutral molecules from a target of a material; and a ionization source configured to ionize at least a portion of the neutral molecules after desorption from the target of the material, the ionization source being a radiofrequency ionization ("RFI") source.

The disclosure also provides a method of imaging a target molecule with a mass spectrometer, comprising: desorbing one or more neutral molecules from a target of a material; and ionizing at least a portion of the neutral molecules into ionized molecules with a radiofrequency ionization ("RH") source after the desorbing of the neutral molecules.

BRIEF DESCRIPTION OF THE SEVERAL VIEWS OF THE DRAWINGS

The FIGURE is a schematic diagram of an exemplary system of the invention.

DETAILED DESCRIPTION

The FIGURE described above and the written description of specific structures and functions below is not presented to limit the scope of what Applicant has invented or the scope of the appended claims. Rather, the FIGURE and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are employed in the written description for clarity in specific reference to the FIGURE and are not intended to limit the scope of the invention or the appended claims. Where appropriate, one or more elements may have been labeled with an "A" or "B" to designate various members of a given class of an element. When referring generally to such elements, the number without the letter can be used. Further, such designations do not limit the number of members that can be used for that function. The term "molecule" is used broadly herein to mean a sub-cellular component and can include one or more atoms. As used in this application, the terms "about" and "approximately" are used as equivalents. Any numerals used in this application with or without about/approximately are meant to cover any normal fluctuations appreciated by one of ordinary skill in the relevant art.

The present disclosure provides a system and method for mass spectrometry imaging in a multi-stage ionization applying different technologies by decoupling the desorption and ionization events. At a first stage, a primary beam, such as an ion beam, desorbs one or more molecules of a targeted sample, and at a second stage the desorbed molecules are ionized. The system and method can act independent of a matrix application to the target sample for a direct analysis and has the resolution needed to operate in nanometers resolution for a cell-by-cell analysis, if desired. The first stage desorption applies a first technique that allows neutral molecules of the target sample to become desorbed from the surface without requiring the molecules to be ionized during the desorption. The second stage ionizes the neutral molecules after the desorption in the first stage, when the defined target molecules have been volatilized, so that the MS analysis is focused on the ionized target molecules. The second stage can use, for example, radiofrequency ionization, different from the first stage.

The FIGURE is a schematic diagram of an exemplary system of the invention. An exemplary material 10 is intended to be analyzed by mass spectrometry ("MS"). A target 12 of specific interest can be identified by a variety of methods, including for example, electron microscopy. The target 12 may be a specific cell or other portion of the material 10. As described above, due to the small size of the target, prior efforts for analyzing such targets with MS procedures have been limited. However, with the system 14 described herein, such analysis is possible.

A desorption system 16 desorbs portions of the material 10 as analytes, generally in the form of neutral molecules 24, from the target 12 as a first stage. The desorption system 16 includes a desorption beam 18 to desorb a portion of the material as neutral molecules. For example, the desorption beam 18 can include an ion beam, cluster beam, or other source beam of sufficient resolution to dislodge accurately the intended target of the material 10 with molecules therefrom. The desorption beam 18 can be a multiple-probe beam assembly that includes neutral, ion and tunable photon beams if a laser source is used. The desorption beam 18 is sufficiently powered to desorb the molecules, but generally is used at a power level below the limit that the beam ionizes the molecules and thus can avoid fragmentation of sensitive or labile molecules in the first stage of desorption. In some embodiments, the intended target does not require the high resolution that an ion beam can provide, so that a lower resolution of a laser is acceptable. Macromolecules on a large surface area are one example. In those embodiments, a laser can be powered at a sufficiently low level to not cause significant concurrent ionization, so that the desorbed target molecules as analytes are generally neutral. The desorption system 16 generally includes controls, a power supply, and instrumentation as would be known to those with ordinary skill in the art to produce a primary ion beam, laser beam, or another desorption beam 18.

The system 14 further includes a second stage that ionizes the desorbed molecules 24 after the desorption in the first stage. An ionization system 20 includes controls, power supply and instrumentation as would be known to those with ordinary skill in the art to produce an ionization source 22. The ionization source 22 produces ionized molecules 26 from the desorbed neutral molecules 24. Advantageously, the ionization source 22 can be a radio frequency ionization ("RFI") source. The use of RFI as a secondary ionization source provides the ability to ionize polar and non-polar analytes. In some embodiments, the geometry of an RFI source can be optimized to ionize a substantially larger portion of the desorbed molecules 24 than currently possible with traditional secondary ionization sources, such as lasers. Further, the use of RFI is expected to reduce a power requirement of the primary desorption beam 18 that no longer has to desorb as well as concurrently ionize. It is believed that the power requirement can be reduced, such that imaging resolution in the X-Y (surface) and Z (depth) dimensions supports molecular-level characterization of drugs and other molecular species of interest in single-cell environments. Further, the RFI source can be operated in a chamber 38, which in some embodiments can be under high vacuum conditions. The vacuum conditions in which the RFI source can operate can overcome limitations in other ionization methods that do not operate in vacuum environments, including electrospray (ESI), high-pressure MALDI, and other techniques.

The present system contrasts with prior systems which use laser as primary beams in that the typical laser beam both desorbs and ionizes, whereas in the present embodiment, even if a laser is used to desorb molecules, the laser can be operated at a lower power than currently used because the laser is not required to ionize at the desorption event. The laser only needs sufficient power or photon density to desorb neutral molecules at the first stage.

Further, in some embodiments, ion beams can be used as the primary desorption beams down to nanometer range resolution for desorbing molecules of interest. Such use provides higher sensitivity or lower power input than currently possible. The RFI used as an ionization source has high ionization efficiencies that can be orders of magnitude higher than electron impact ionization for most organic molecules. Further, RFI provides flexibility with the desorption system and the desorption beam resulting therefrom. Because the present system does not require a matrix substance to be overlaid onto the material 10 as is currently done in MALDI techniques, the present system minimizes unwanted and potential reactions with solvent molecules, and analyte migrations associated with the use of ionization solvents or matrix reagents. Due to the lower energy in the desorption beam, the heating and surface damage of the material 10 can be minimized. Further, in some embodiments, the ionization source, such as an RFI source, can be tuned to yield soft ionization to generate intact molecular ions or hard ionization to generate fragment ions for additional structural characterizations. This soft or hard ionization would generally occur on the already desorbed molecules in contrast to current techniques.

The ionized molecules 26 can be directed through a magnetic or an electric field 28, or a combination of the two fields, to create a magnetic and/or electric field path 29 for the ionized molecules 26. These magnetic and/or electric field paths of the ionized molecules are directed toward a MS detector-analyzer 30. The detector-analyzer 30 can measure parameters, such as flight times, or radial distributions of the ions, and other known parameters typically measured in IMS and MS. The results can be processed in a processor 32 having an output 34. The output can be visual, print, audio, or remotely transmitted to other sources as various outputs. The data from the processing in the processor can be stored temporarily or permanently in a storage medium 36. For example and without limitation, an MS detector-analyzer 30 can be any ultrahigh resolution instrument, such as an FT-ICR mass spectrometer equipped with a superconducting magnet. Alternative detector-analyzer systems include nonmagnetic-based systems, such as time-of-flight (TOF) instruments and ion mobility systems, and more specifically, as an example, Waters G2 Synapt-HDMS, that may be capable of faster data acquisition than a magnetic based system. In such an embodiment, the magnetic field 28 would not be required. Other configurations and types of mass spectrometers can be used.

Other and further embodiments utilizing one or more aspects of the invention described above can be devised without departing from the spirit of Applicant's invention. For example, it is possible to have various combinations of desorption beams as a primary beam to desorb the target material and ionization sources as the second beam to subsequently ionize the desorbed molecules. Other variations include magnet and non-magnet analyzer-detectors, ion mobility detectors, various types of materials and resulting molecules for analysis with the system, various processors, and storage media, including cloud storage, and other variations in keeping with the scope of claims.

Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "coupled," "coupling," "coupler," and the like are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

REFERENCES

ESI: Fenn, J. B., Mann, M., Meng, C. K. & Wong, S. F. (1990) Mass Spectrom. Rev. 9, 37.

MALDI: Karas, M., Bachmann, D., Bahr, D. & Hillenkamp, F. (1987) Int. J. Mass Spectrom. Ion Processes 78, 53.

Cf Desorption: Sundqvist, B. & Macfarlane, R. D. (1985) Mass Spectrom Rev. 4, 421.3. B. Zekavat and T. Solouki, Radio-Frequency Ionization of Organic Compounds for Mass Spectrometry Analysis, Angew. Chem. Intl. Ed., 52, (2013), 2426-2429.

James E. Penner-Hahn, Technologies for Detecting Metals in Single Cells, 12 Met. Ions Life Sci. 15, (2013), 15-40.

T. Rohner, D. Staab, M. Stoeckli, MALDI mass spectrometric imaging of biological tissue sections, Mechanisms of Aging and Development 126 (2005), 177-185.

What is claimed is:

1. A system for mass spectrometry, comprising: a desorption beam configured to desorb neutral molecules from a target of a material independent of a matrix solution applied to the target: and an ionization source configured to ionize at least a portion of the neutral molecules after desorption from the target of the material to form ionized molecules, the ionization source being a radiofrequency ionization ("RFI") source.

2. The system of claim 1, wherein the desorption beam comprises an ion beam.

3. The system of claim 1, wherein the desorption beam comprises a laser photon beam.

4. The system of claim 1, further comprising a mass spectrometer configured to receive the ionized molecules.

5. A method of imaging a target molecule with a mass spectrometer, comprising: desorbing one or more neutral molecules from a target of a material independently of a matrix solution applied to the target with a desorption beam configured to desorb neutral molecules; and ionizing at least a portion of the neutral molecules into ionized molecules with a radiofrequency ionization ("RFI") source after the desorbing of the neutral molecules.

6. The method of claim 5, wherein desorbing the neutral molecules comprises desorbing with an ion beam.

7. The method of claim 5, wherein desorbing the neutral molecules comprises desorbing with a laser photon beam.

8. The method of claim 5, further comprising analyzing at least a portion of the ionized molecules passing through a magnetic field.

9. The method of claim 5, further comprising analyzing at least a portion of the ionized molecules independent of a magnetic field.

10. The system of claim 1, wherein the desorption beam is configured to desorb neutral molecules from a target of a sample to be analyzed of the material.

11. The method of claim 5, wherein desorbing one or more neutral molecules from a target of a material comprises desorbing one or more neutral molecules from a target of a sample to be analyzed of the material.

* * * * *